US006701543B1

(12) United States Patent
Haq

(10) Patent No.: US 6,701,543 B1
(45) Date of Patent: Mar. 9, 2004

(54) CHILD-SAFETY WATER SPILL-GUARD

(76) Inventor: Ataul Haq, 55 Greenleaf Ter., Stafford, VA (US) 22556

( * ) Notice: Subject to any disclaimer, the term of this patent is extended or adjusted under 35 U.S.C. 154(b) by 0 days.

(21) Appl. No.: 10/251,768

(22) Filed: Sep. 23, 2002

(51) Int. Cl.[7] ..... A47K 3/00

(52) U.S. Cl. ..... 4/559; 4/558; 4/609; 4/610; 4/658; 4/300.3

(58) Field of Search ..... 4/559, 558, 608, 4/609, 610, 658, 300.3, DIG. 18, 519, 520, 523; 160/349.1, 349.2

(56) References Cited

U.S. PATENT DOCUMENTS

| | | | | | |
|---|---|---|---|---|---|
| 1,791,696 | A | * | 2/1931 | Alexander | 4/609 |
| 2,501,829 | A | * | 3/1950 | Rugh | 4/520 |
| 3,444,564 | A | * | 5/1969 | Lavacchia | 4/559 |
| 5,249,315 | A | * | 10/1993 | Moylan | 4/559 |
| 5,772,490 | A | * | 6/1998 | Leach | 4/580 |

* cited by examiner

*Primary Examiner*—Gregory L. Huson
*Assistant Examiner*—Khoa Huynh

(57) ABSTRACT

A foldable/collapsible Child-Safety Water Spill-Guard with soft magnet or suction cup grippers attaches itself to a bathtub or Jacuzzi in an inclined fashion at any preferred place with out a need of permanent attachments. This child-safety water-spill guard comprises of a water proof sheet of plastic or fabric approximately the length of a standard tub with stiff nylon or plastic ribs spaced through out the length of the sheet. Each rib is essentially a two piece configuration, the longer of these rib pieces essentially have a wedge at the bottom; whereas under side of each rib is a soft/flexible magnet or suction cup secured with fusion, glue or plastic-weld etc., so when the safety spill-guard is placed and stretched along the long side of a bathtub the bottom section of the safety spill-guard is folded and wrapped on the inside of the bathtub hanging down from the rim sticking to the inner surface securely. While the rest of the guard sits over the edge of the tub making an inclined surface protruding outward approximately a foot or so. The water spillage from the tub falls on the extended portion of the guard and is momentarily flows back to the tub. This very secured yet very flexible safety water spill-guard can prevent slip hazard for kids and also protect the bath floor. Another important feature of this child-safety water spill-guard is that kids taking bath and playing in the bathtub are visible and are under surveillance by the parent or guardian. Another advantage is that this guard can be moved and placed again with extreme ease and can be folded, collapsed and stored in a compact place.

2 Claims, 2 Drawing Sheets

CHILD-SAFETY WATER SPILL-GUARD

BACKCROUND OF THE INVENTION

1. This invention relates generally to Bathtubs and, more specifically, the invention is a Child-Safety Water-Spill Guard for bathtubs for preventing water from being splashed out of the bathtub, making the bathroom floor slippery creating child hazard and also tends to destroy bathroom floor.

2. Particularly when child/children are playing in the tub while taking bath are not obscure from the eyes of parent/guardian. This child-safety water-spill guard is flexible, collapsible and easily attachable to the bathtub, unlike other guards, which are permanent or requires some permanent attachments and are very cumbersome to install/remove and store.

3. In reality, children tend to play, and splash lot of water while taking bath. Although shower curtains can prevent the spillage, but shower curtains are not desirable due to the fact that they obscure children and that children don't want to bath with the curtains drawn.

DISCRIPTION OF PRIOR ART

4. Many water spill guards for bath have been proposed in the art. However, none of the prior art relates and/or provide child safety and easy of installation/removal and storage. Therefore, making the art non practical for the purpose.

5. Patent of Alexander discloses a bath shield for preventing water splashing outside of the bathtub using flexible waterproof fabric or rubber along with the clamps made of wire or some hard material. The obvious draw back is that these clamps are of rigid configuration and cannot be used on different size and shape of bathtubs. Another draw back is that clamps being made of hard material are hazardous to children and if moved accidentally, will loose its grip.

6. Patent of Smith, disclose essentially a curtain, which will prevent water from spillage but will obscure child from parent/guardian while taking bath therefore making it hazardous.

7. Therefore, it is desirable to have a water spill guard, providing child safety at the same time in particular and yet providing other benefits as protection of bathroom floor.

SUMMARY OF THE INVENTION

8. The invention in general relates to Bathtubs, more specifically the invention is a Child-Safety Water Spill-Guard for bathtubs, for preventing water from being splashed out of the bathtub making the floor hazardous and also the spilled water tends to destroy bathroom floor after soaking. This child-safety water spill-gaurd comprises of a collapsible waterproof sheet having magnets or suction cups for attachment to the rim of a bathtub. Hard plastic ribs spaced along the length of the sheet, rigidly maintain the sheet in an inclined and open configuration, so the water spilled thereon, readily flows back into the tub without spilling onto the bathroom floor. When not in use, the guard can be collapsed and folded into a convenient compact size for storage.

BRIEF DISCRIPTION OF DRAWINGS

Figure 1:
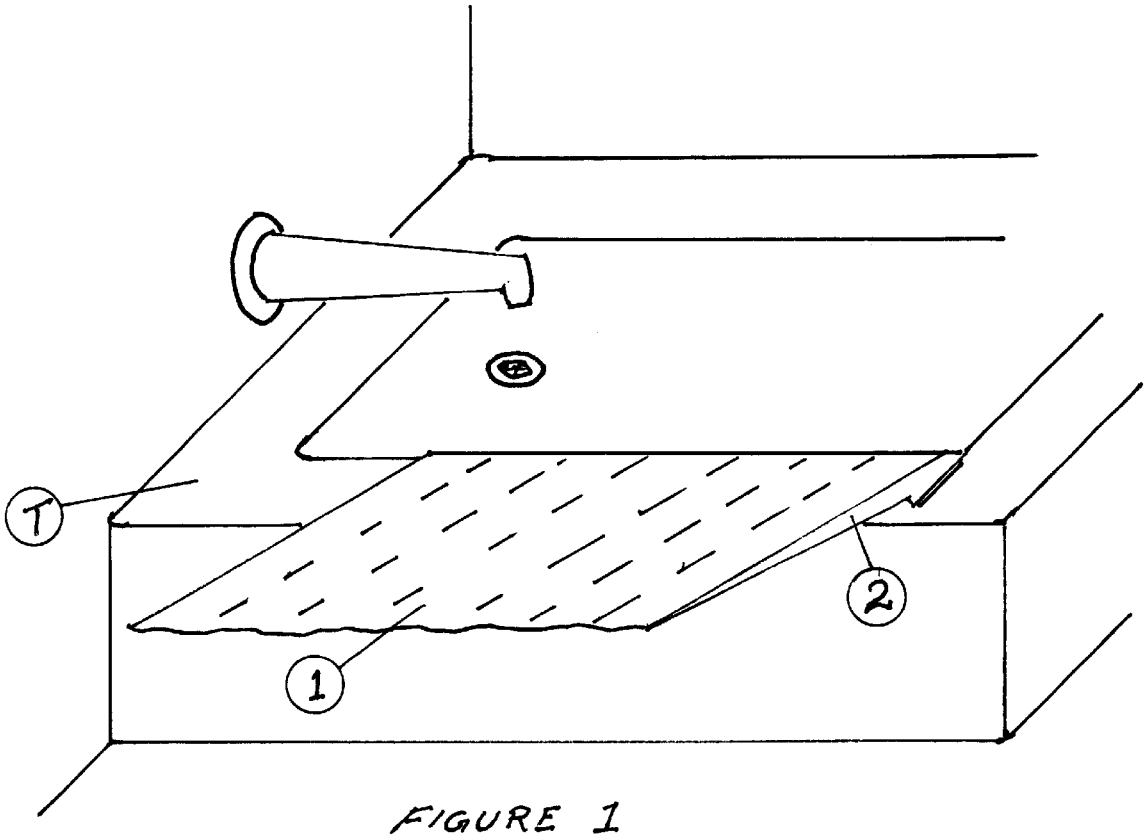

9. FIG. 1 depicts the fabricated Child-Safety Water Spill-Guard comprises of water proof sheet (a), two part inclined ribs (b) and magnets/suction cup (c).

Figure 2:
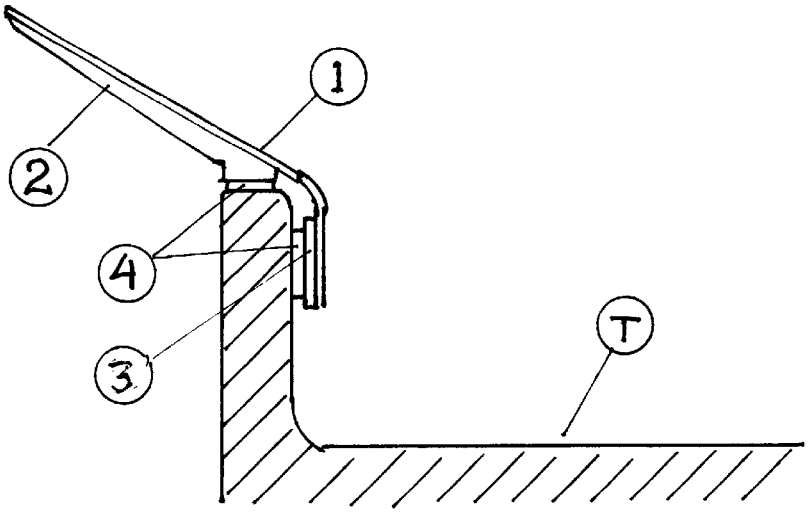
Figure 3:
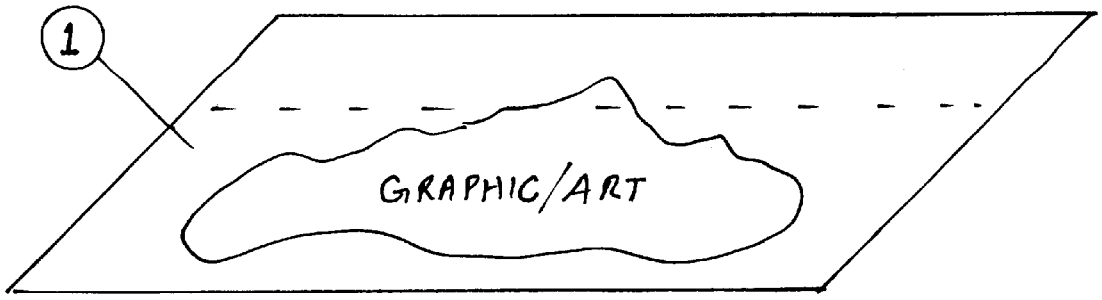
Figure 4:
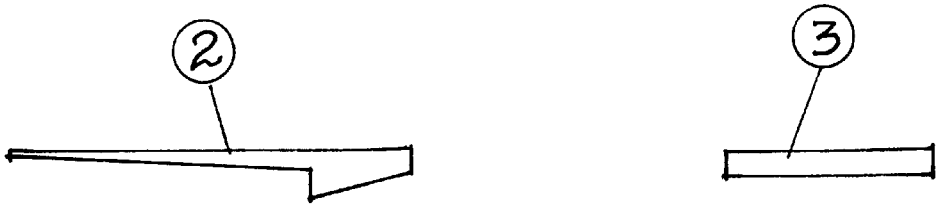
Figure 5:
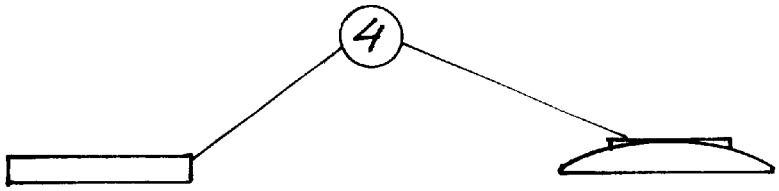

10. FIG. 2 explains the elements separately. Drawing A, details the waterproof sheet with foldable creases shown along with some graphics/art etc. Drawing B, shows details of rib 1 & 2. Note the rib 2 has bottom wedged to provide inclination at installation. Drawing C, details the gripping elements, magnets and suction cups.

DETAIL DESCRIPTION OF PREFFERED EMBODIMENT

11. As best illustrated in the attached sheets, this child-safety water spill-guard is made of minimum of three elements. All these elements are fabricated in a way to make one collapsible and foldable safety water spill guard.

12. Element 1 is a water proof sheet made of plastic, fabric or like material approximately a length of standard water tub, Jacuzzi or other bathing container. The width of the fabric is foot and half or more with at least one foldable crease along the length of the sheet and approximately six inches from the edge that meant to be inside the tub after installation. This waterproof material is art with graphics, which are liked and desirable by children.

13. Element 2 is a stiff rib made of plastic, nylon or like material approximately one inch wide and equal to the width of the sheet in length, called rib. Each rib consist of two pieces, the smaller piece is approximately equal to the distance from the edge of the sheet and the foldable crease on the sheet. The bigger rib piece is approximately equal to the remaining width of the sheet and its bottom is wedged at the beginning of the crease on the sheet and up to the width of the rim of tub, in order to provide a desired inclination when it is placed on the rim of the tub. These ribs are spaced along the length of the sheet at a desired spacing. There is a desired gap between these two ribs in order to allow the fabric or sheet to easily fold along the curve of the inside edge of the tub at the rim.

14. Element 3 is magnet strip (soft or hard) or suction cup which when applied to the tub surfaces, sticks to the tub surface securely enough to hold the guard in desired position. Element 3 is placed under each rib piece permanently secured by glue, weld, fusion or like process to withstand the desired purpose and stay water proof.

15. All these elements are fabricated to form the desired Child-Safety Water Spill-guard which is installed on the side of the tub that is open to the bathroom floor in such a way that foldable portion is inside the tub and the other portion is rested and secured on the rim of the tub making an inclined surface for spilled water to get trapped and flown back into the tub.

I claim:

1. A fabricated child-safety water spill guard for use in a bath tub, Jacuzzi or similar bathing containers, comprising two fabricated ribs connected together by a water proof sheet fabric, said ribs configured to be mounted over an upper rim of the sidewall of said tub, said ribs further includes a first long rib having an inclined wedge shape bottom and a second short rib having plain bottom; said water proof sheet fabric attached permanently on a top side of each of the ribs and magnets or suction cups disposed on an opposite bottom side of each of the said ribs, said first rib adapted to be attached securely on said upper rim of the sidewall of the bath tub in a manner that said first rib with its wedge shape bottom sits securely on a horizontal plane of said top edge surface, thereby stretching one end of the said water proof sheet fabric at an inclined angle over the edge of the tub extended outwardly over the bathroom floor, and said second rib adapted to be mounted to an inside surface of the sidewall of said tub in a manner that said second rib with its plain bottom securely attached to said inside surface of the sidewall of the tub, thereby stretching an opposite end of said sheet fabric disposed inside the tub over said second short rib, wherein water spilled beyond the tub edge is caught and drained toward the inside the tub via inclined water proof sheet fabric, wherein said water spill guard has a flexibility of attaching to any size and shape of the tub edge and wall thickness, and wherein the said stretch water proof sheet fabric over the edge of the tub providing the inclined stretched surface with structural rigidity and yet complete flexibility of installation, removal and storage.

2. The child-safety water spill guard according to claim 1, whereas the ribs are attached to the water proof sheet with a spacing in order to provide contour folding along the corner of the tub formed by the horizontal flat edge and the inside wall of the tub, so that when placed over the outside edge of a tub will stretch the water proof fabric over the bathroom floor and other end of fabric is disposed firmly inside the tub.

* * * * *